US009994424B2

(12) United States Patent
Kere et al.

(10) Patent No.: US 9,994,424 B2
(45) Date of Patent: Jun. 12, 2018

(54) ELEVATOR SYSTEM

(71) Applicants: Petri Kere, Helsinki (FI); Marja-Liisa Siikonen, Helsinki (FI); Mirko Ruokokoski, Veikkola (FI); Petteri Valjus, Helsinki (FI); Raimo Pelto-Huikko, Vantaa (FI)

(72) Inventors: Petri Kere, Helsinki (FI); Marja-Liisa Siikonen, Helsinki (FI); Mirko Ruokokoski, Veikkola (FI); Petteri Valjus, Helsinki (FI); Raimo Pelto-Huikko, Vantaa (FI)

(73) Assignee: Kone Corporation, Helsinki (FI)

( * ) Notice: Subject to any disclaimer, the term of this patent is extended or adjusted under 35 U.S.C. 154(b) by 77 days.

(21) Appl. No.: 14/954,148

(22) Filed: Nov. 30, 2015

(65) Prior Publication Data

US 2016/0083224 A1 Mar. 24, 2016

Related U.S. Application Data

(63) Continuation of application No. PCT/EP2014/063961, filed on Jul. 1, 2014.

(30) Foreign Application Priority Data

Jul. 4, 2013 (EP) ..... 13175078

(51) Int. Cl.
*B66B 9/00* (2006.01)
*B66B 7/06* (2006.01)

(52) U.S. Cl.
CPC ..... *B66B 9/00* (2013.01); *B66B 7/06* (2013.01); *B66B 7/062* (2013.01); *B66B 2009/006* (2013.01)

(58) Field of Classification Search
CPC ..... B66B 9/00; B66B 7/06; B66B 7/062
See application file for complete search history.

(56) References Cited

U.S. PATENT DOCUMENTS 3,750,849 A 8/1973 Berkovitz
5,107,962 A * 4/1992 Ekholm ..... B66B 9/00 187/249

(Continued)

FOREIGN PATENT DOCUMENTS

EP 12003610 * 5/2012
JP 2006298620 A 11/2006

(Continued)

OTHER PUBLICATIONS

International Search Report for PCT/EP2014/063961 dated Sep. 4, 2014.

(Continued)

*Primary Examiner* — Michael A Riegelman
(74) *Attorney, Agent, or Firm* — Harness, Dickey & Pierce, P.L.C.

(57) ABSTRACT

The invention relates to an elevator system comprising a first elevator car, a second elevator car, a rotatable rope wheel mounted on a fixed location, and a roping suspending the first and second elevator car on opposite sides of the rope wheel, the roping comprising at least one rope passing over the rope wheel, and connected on the first side of the rope wheel to the first elevator car and on the second side to the second elevator car. Said rope comprises at least one load bearing member oriented parallel with the longitudinal direction of the rope made of composite material comprising reinforcing fibers embedded in polymer matrix, which reinforcing fibers are carbon fibers oriented parallel with the longitudinal direction of the rope.

22 Claims, 4 Drawing Sheets

(56) References Cited

U.S. PATENT DOCUMENTS 5,857,545 A * 1/1999 Barrett ..... B66B 9/003 187/249
6,333,865 B1 * 12/2001 Yumura ..... B66B 7/064 187/295
6,520,295 B1 2/2003 Sansevero et al.
2006/0016640 A1 * 1/2006 Duenser ..... B66B 1/2466 187/249
2008/0149428 A1 * 6/2008 Kocher ..... B66B 9/00 187/249
2009/0301818 A1 * 12/2009 Hashiguchi ..... B66B 9/00 187/249
2011/0000746 A1 1/2011 Pelto-Huikko et al.
2011/0259677 A1 10/2011 Dudde et al.
2011/0266097 A1 11/2011 Valjus et al.
2013/0118837 A1 * 5/2013 Altenburger ..... B66B 5/0031 187/249
2014/0305744 A1 * 10/2014 Kere ..... B66B 7/1238 187/254
2015/0083524 A1 * 3/2015 King ..... B66B 9/00 187/249
2015/0191332 A1 * 7/2015 Kere ..... B66B 7/062 187/251
2015/0197410 A1 * 7/2015 Aulanko ..... B66B 1/40 187/264
2015/0291390 A1 * 10/2015 Kakio ..... B66B 5/0031 187/249
2016/0039638 A1 * 2/2016 Lehtinen ..... B66B 11/0095 187/266

FOREIGN PATENT DOCUMENTS

WO WO-0187758 A1 11/2001
WO WO-2006011634 A1 2/2006
WO WO-2009090299 A1 7/2009

OTHER PUBLICATIONS

Written Opinion for PCT/EP2014/063961 dated Sep. 4, 2014.
European Search Report for EP13175078 dated Nov. 26, 2013.

* cited by examiner

ELEVATOR SYSTEM

This application is a continuation of PCT International Application No. PCT/EP2014/063961 which has an International filing date of Jul. 1, 2014, and which claims priority to European patent application number 13175078.8 filed Jul. 4, 2013, the entire contents of both of which are incorporated herein by reference.

FIELD OF THE INVENTION

The invention relates to an elevator system comprising plural elevator cars meant for transporting passengers and/or goods.

BACKGROUND OF THE INVENTION

Elevators typically have one car and one counterweight traveling vertically in a hoistway. These elevators have a suspension roping for suspending the elevator car and the counterweight on opposite sides of a rotatable rope wheel. The suspension roping passes around the rope wheel, which is mounted on a fixed location, whereby the ropes can take support from the rope wheel for suspending the elevator car and counterweight. The drawback of this kind of elevator is that in some cases it cannot utilize the hoistway space optimally in terms of transport capacity. For example, the lower parts of the hoistway are not available for people flow when the car is at the top end of the hoistway. Generally, the higher the hoistway is, the less efficiently the elevator provided with only one elevator car can utilize the whole height thereof. This drawback has been solved in prior art by placing two independent elevators on top of each other in the same (i.e. common) hoistway. Thus, one of them can serve the bottom floors and the other can serve the top floors. The drawback of this kind of elevator system is that it requires two hoisting machines and two ropings, which makes the elevator system expensive and difficult to modify later. Also, usually it is necessary to form a space vertically between the elevators for accommodating the hoisting machine of the lower one of the elevators, which makes it difficult to serve the floors between the elevators. It would be advantageous if the elevator system could be formed without multiple hoisting means for moving the two elevator cars, such as with only one hoisting machine and/or only one hoisting roping. This, however, has not been feasible in practice for great lifting heights, because the cars tend to be positioned irregularily relative to the landing that they stop. In particular, it has been difficult to position the two cars suspended by a common roping so that they are level with their landings simultaneously. Said irregularities have necessitated complicated adjustment devices of great adjustment ranges for carrying out the adjustment of position of the elevator cars so that they are level with a landing simultaneously.

BRIEF DESCRIPTION OF THE INVENTION

The object of the invention is to introduce an improved elevator system, which has multiple elevator cars connected with a common suspension roping. The object of the invention is, inter alia, to solve previously described drawbacks of known solutions and problems discussed later in the description of the invention. The object of the invention is, in particular, to introduce an improved elevator system in terms of positioning of the elevator cars. Embodiments are presented, inter alia, which facilitate the positioning of multiple cars to be simultaneously level with their landings.

It is brought forward a new elevator system comprising a first elevator car traveling vertically in a hoistway, a second elevator car traveling vertically in a hoistway, and a rotatable rope wheel mounted on a fixed location. The elevator system further comprises a roping suspending the first and second elevator car on opposite sides of the rope wheel, the roping comprising at least one rope, which passes over the rope wheel, and it is connected on the first side of the rope wheel to the first elevator car and on the second (opposite) side to the second elevator car. Each of said at least one rope comprises at least one load bearing member oriented parallel with the longitudinal direction of the rope, which load bearing member is made of composite material comprising reinforcing fibers embedded in polymer matrix, which reinforcing fibers are carbon fibers oriented parallel with the longitudinal direction of the rope in question. The reinforcing fibers are substantially untwisted relative to each other. With the defined configuration one or more of the above given objects or advantages are achieved. It has been recognized that the difficulties in leveling the cars with elevators of great lifting height are due to great rope elongation, which is due to changes in car load and car position. The car position changes have previously caused leveling problems due to the forces caused on the portions of the suspension roping which is under tension. The great weight of the rope itself or the weight of the compensation roping hanging from the car suspended by the suspension roping has caused a dependency of the car position. A complicating factor is that the length of the portion of the suspension roping which is under tension, i.e. the portion of the roping the elongation of which is important for the leveling, is dependent on car position. Problems with car positioning are hereby solved by reducing rope elongation. In particular, the sensitivity for rope elongation problems is now reduced by making the suspension roping very stiff in its axial direction. At the same time also the causes for of rope elongation are reduced by considerably reducing the dependency of the car position by forming the ropes of light-weighted material. This reduces the effect of the changing car position on the length of the suspension roping. Thus, irregularities in length of ropes of the suspension roping are reduced and thereby also the irregularities in position of the cars relative to each other can be reduced, which makes it easier to level them on landings.

In a preferred embodiment, the elevator system comprises at least two landings for the first elevator car and at least two landings for the second elevator car(s) (i.e. landings where the car in question can stop to load or unload passengers), positioned such that when the first elevator car is level with one of its landings, the second elevator car is level with one of its landings. Hereby, the first and the second car(s) can be unloaded or loaded simultaneously. The operation of the elevator is hereby efficient as in this way the stopping frequency of the elevator can be reduced.

In a preferred embodiment, the elevator system comprises at least two landings for the first elevator car and at least two landings for the second elevator car(s), i.e. where the car can stop to load or unload passengers, positioned such that when the first elevator car is down in its hoistway and level with a landing, the second elevator car is up in its hoistway and level with a landing, and when the first elevator car is up in its hoistway and level with a landing, the second elevator car is down in its hoistway and level with a landing. Hereby, the first and the second car(s) can be unloaded or loaded simultaneously while they are at opposite ends of the hoistway(s).

In a preferred embodiment, the elevator system comprises a hoisting machine for moving the elevator cars. Preferably, the hoisting machine is arranged to move the elevator cars by moving the roping. This is realized for example when the hoisting machine comprises a motor for rotating said rotatable rope wheel.

In a preferred embodiment, the elevator system comprises a hoisting machine for moving the elevator cars, comprising a motor for rotating said rotatable rope wheel.

In a preferred embodiment said rotatable rope wheel and the motor for rotating said rotatable rope wheel are both within the hoistway in which the first and/or the second elevator car is arranged to travel.

In a preferred embodiment, each of said at least one load bearing member has width greater than thickness thereof in the width-direction of the rope. In particular, it is preferable that each of said at least one rope is in the form of a belt. Large width makes it well suitable for elevator use as bending of the rope is necessary in most elevators. The rope, in particular the load bearing member(s) thereof, can in this way be given a large cross-sectional area, which facilitates feasible dimensioning of the stiffness of the roping such that it is adequate for the pursued simultaneous leveling of the cars.

In a preferred embodiment, said at least one rope comprises a plurality of ropes of the defined structure.

In a preferred embodiment, each of said at least one rope is in the form of a belt and comprises a plurality of load bearing members placed adjacent each other in the width direction of the belt and on the same plane.

In a preferred embodiment, the elevator has the same number of first cars and second cars suspended by the roping on the opposite sides of the rope wheel.

In a preferred embodiment, the first car and the second car are arranged to travel vertically in the same hoistway one above the other. In this way, the elevator system utilizes one long elevator hoistway efficiently.

In a preferred embodiment, the first car(s) and the second car(s) are suspended with the same suspension ratio. Thus, their moving speeds and lengths can be made equal which facilitates efficiency and simplicity of the system.

In a preferred embodiment, the first and the second car are both suspended by the roping with 1:1 suspension ratio. Then, the first end of the rope(s) is/are fixed to the first car and the second end(s) of the rope(s) is/are fixed to the second car. In an alternative preferred embodiment, the first and the second car are both suspended by the roping with suspension ratio 2:1. Then, on the first side of the rope wheel the rope(s) is/are connected to the first car via a first rope wheel arrangement mounted on the first car and on the second side of the rope wheel the rope(s) is/are connected to the second car via a second rope wheel arrangement mounted on the second car.

In a preferred embodiment, the first car and the second car are arranged to travel vertically in the same hoistway one above the other, and on the first side of the rope wheel the rope(s) descend(s) to the first elevator car passing the second car at the side thereof. Thus, the roping can be routed to the lower one of the cars without touching the upper one of the cars. In one preferred embodiment, the rope(s) descend(s) further to a rope wheel arrangement, which is arranged to guide the rope(s) laterally to descend to the first car within the vertical projection thereof. Thus, a central suspension can be provided also for the lower (first) elevator car. Then the end(s) of rope(s) descending to the first car within the vertical projection of the first car are preferably fixed to a fixing point on top of the first car, in particular to a fixing point at the center of the roof of the first car. In an alternative preferred embodiment, the rope(s) are guided by a first rope wheel arrangement mounted on the first car to underloop the first car, which is the lower of the first and second car traveling in a common hoistway. Thus, no additional space is consumed above the lower of the cars and the cars can be arranged to travel close to each other. More specifically, it is preferable that the second rope wheel arrangement is mounted on top of the second car, which is in this case the upper of the first and second car traveling in a common hoistway, and the first rope wheel arrangement is mounted below the first car, which is in this case the lower of the first and second car traveling in a common hoistway. In this way, both cars are suspended without consuming space between them.

In a preferred embodiment, the first car and the second car are arranged to travel vertically in adjacent hoistways. Thus, they can simply share a floor to be served and/or their traveling zones can be chosen relatively freely.

In a preferred embodiment, the first elevator car is suspended by the common roping with a suspension ratio 1:1 and the second elevator car is suspended by the common roping with a suspension ratio 2:1.

In a preferred embodiment, the traveling zone of the first car has twice the length of the traveling zone of the second elevator car.

In a preferred embodiment, the first car and the second car are suspended by the roping with different suspension ratios.

In a preferred embodiment, on the first side of the rope wheel the end(s) of the rope(s) is/are fixed to the first car and on the second side the rope(s) is/are connected to the second car(s) via rope wheel arrangement(s) mounted on the second car(s). Thus, the first car can be fitted to have a longer range of movement than the second car(s).

In a preferred embodiment, the roping suspends a different number of cars on the opposite sides of the rope wheel.

In a preferred embodiment, on the first side of the rope wheel the ropes are connected to one first car and on the second side part of these ropes is connected to a first second car and part of these ropes of the roping is connected to a second second car. Thus, a great number of elevator cars is moved with one roping. The second cars can be dimensioned lighter than the first car, if needed, so as to fit the weights on opposite sides of the rope wheel equal.

In a preferred embodiment, on the first side of the rope wheel the ends of ropes are connected to one first car and on the second side part of these ropes is connected to a first second car via a rope wheel arrangement mounted on the first second car and part of the ropes of the roping is connected to a second second car via a rope wheel arrangement mounted on the second second car. Thus, the greater suspension ratio is used to compensates for the smaller number of suspension ropes suspending each of the second cars. Thereby, the different number of cars suspended on opposite sides of the rope wheel can be made possible.

In a preferred embodiment, the first car is arranged to travel in a different hoistway than the first second car and the second second car. This makes it possible that they can simply have overlapping vertical moving ranges.

In a preferred embodiment, the first car, the first second car and the second second car are arranged to travel all in different adjacent hoistways. This makes it possible that they can simply have overlapping vertical moving ranges.

In a preferred embodiment, the topmost landing of the first elevator car and a lowermost landing of the second elevator car are successive landings of a building having said elevator system. Thus, the first and second car can simply work as local elevators which can be fed by a shuttle elevator. Then, the first car can move passengers downwards and the first car upwards. In combination with this embodiment, it is preferable that the first car and the second car are arranged to travel vertically in the same hoistway one above the other. In this way, the elevator system utilizes one long elevator hoistway very efficiently. In this way, the elevator system also utilizes the cross-section of the building very efficiently. Furthermore, the successive landings can be fed by a shuttle elevator simply.

In a preferred embodiment, the elevator system comprises a shuttle elevator car, which is arranged to travel in a different hoistway than the first and second elevator car and to transport passengers between lobby of the building and one or both of said successive landings. Thus, the shuttle elevator can transport traffic to said successive landings wherefrom the first car can move passengers downwards and the first car upwards. Said building lobby is preferably either an exit lobby of the building, such as a lobby substantially at the ground level of the surroundings of the building, or a skylobby of the building. Thus, an effective elevator system is provided in simple and compact fashion. In the embodiment, where the first car and the second car are arranged to travel vertically in the same hoistway one above the other, said building lobby is preferably located substantially lower than the lowermost landing of the first car which is the lower of the first and second car traveling in a common hoistway. Thus, efficient passenger transport from said building lobby, which is positioned low in the building, to upper parts of the building is provided by feeding with the shuttle elevator the first and second car working as local elevators.

In a preferred embodiment, the elevator system comprises an escalator for transporting passengers between the topmost landing of the first elevator car and a lowermost landing of the second elevator car. In this way, passenger flow between these successive landings is facilitated even if a shuttle elevator does not stop at each of these landings.

In a preferred embodiment the load bearing member(s) of the rope cover(s) majority, preferably 70% or over, more preferably 75% or over, most preferably 80% or over, of the width of the rope. Thus, the width of the rope is effectively utilized for the function of load bearing.

In a preferred embodiment said the width/thickness ratio(s) of said load bearing member(s) is/are at least 2, preferably at least 3. In case the rope comprises only on load bearing member, it is preferable that the width/thickness ratio(s) of said load bearing member(s) is at least 5, or more. Thus, a turning radius well suitable for elevator use is achieved.

In a preferred embodiment the polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. A hard matrix helps to support the reinforcing fibers, especially when the rope bends, preventing buckling of the reinforcing fibers of the bent rope.

In a preferred embodiment over 50% of the cross-sectional square area of the load-bearing member consists of said reinforcing fiber.

The elevator system is preferably installed inside a building, such as a tower building. Each of the cars is preferably arranged to serve two or more landings. The cars preferably respond to calls from landing(s) and/or destination commands from inside the car so as to serve persons on the landing(s) and/or inside the elevator car. Preferably, each of the cars has an interior space suitable for receiving a passenger or passengers.

BRIEF DESCRIPTION OF THE DRAWINGS

In the following, the present invention will be described in more detail by way of example and with reference to the attached drawings, in which.

DETAILED DESCRIPTION

Figure 1:
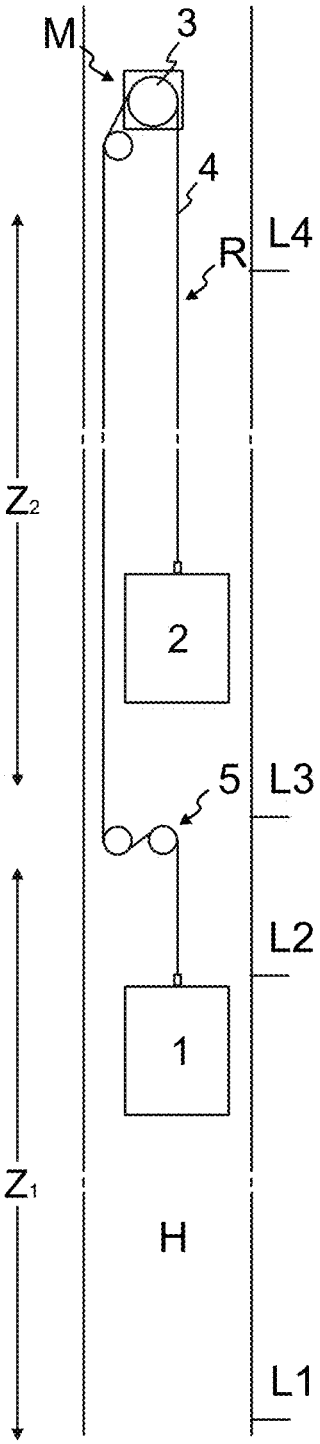
FIG. 1 illustrates a first preferred embodiment of the elevator system.

In each of FIGS. 1-4 an elevator is illustrated, which comprises a first elevator car 1,1',1",1'" traveling vertically in a hoistway H,H',H1",H1'" and a second elevator car 2, 2', 2", 2*a*'", 2*ab*" traveling vertically in a hoistway H, H',H2", H2*a*'", H2*b*'". Each of these elevators comprises a rotatable rope wheel 3, 3', 3", 3'" mounted on a fixed location, a roping R, R', R", R'" suspending both the first and the second elevator car 1,1',1",1'"; 2, 2', 2", 2*a*'", 2*ab*" on opposite sides of the rope wheel 3, 3', 3", 3'". The roping R, R', R", R'" comprises one or more ropes 4, 4', 4", 4*a*'", 4*b*", which pass(es) over the rope wheel 3, 3', 3", 3'", and is/are connected on the first side of the rope wheel 3, 3', 3", 3'" to the first elevator car 1,1',1",1'" and on the second (opposite) side to the second elevator car 2, 2', 2", 2*a*'", 2*ab*". The first and the second elevator car are hereby suspended by a common roping R, R', R", R'" on opposite sides of the rope wheel 3, 3', 3", 3'", the first and second elevator car working as counterweights for each other. Thereby, when the first elevator car moves up, the second elevator car moves down, and vice versa. In this way, an economical elevator system is formed where a movable elevator unit is moved on both sides of the rope wheel 3, 3', 3", 3'", which movable elevator unit can receive passengers and transport them. The elevator system of this kind can provide good transporting capacity with respect to the size of the hoistway(s) thereof, as no hoistway space needs to be reserved for such movable elevator units, which are not usable for receiving and transporting passengers. The roping R, R', R", R'" may have one or more of said ropes 4, 4', 4", 4*a*'", 4*b*", but preferably it has at least two of said ropes 4, 4', 4", 4*a*'", 4*b*", preferably even more for the sake of safety. Each of said ropes 4, 4', 4", 4*a*'",4*b*" is made stiff in its longitudinal direction. For this end, of said ropes 4, 4', 4", 4*a*'",4*b*" comprises one or more load bearing member(s) 101, 101' oriented parallel with the longitudinal direction of the rope 4, 4', 4", 4*a*'",4*b*" and is made of composite material, which composite material comprises reinforcing fibers f embedded in polymer matrix m, which reinforcing fibers f are carbon fibers oriented parallel with the longitudinal direction of the rope 4, 4', 4", 4*a*'", 4*b*". Carbon fibers have a very high tensile stiffness. Resulting from both the straight structure and the material selection, the load bearing member(s) of the rope 4, 4', 4", 4*a*'",4*b*" is/are stiff in the longitudinal direction of the rope 4, 4', 4", 4*a*'",4*b*", making also the rope 4, 4', 4", 4*a*'",4*b*" very stiff in its longitudinal direction. With this rope structure, the roping R, R', R", R'" can be formed stiff enough in its longitudinal direction to make it possible that the first car and second car suspended on opposite sides of the rope wheel 3, 3', 3", 3'" mounted on a fixed location can be driven simultaneously to their landings without a complicated arrangement for adjusting the leveling, or even completely without such an arrangement. The reinforcing fibers f are particularly carbon fibers as a carbon fiber is both lightweighted and stiff in its longitudinal direction. The mass of the rope is with this material selection and structure of the load bearing member formed so low with respect to its stiffness, that the rope is substantially insensitive to the changes of car position in terms of rope elongation due to its own mass. This is the case even with the greatest lifting heights, such as lifting heights of several hundreds of meters. Thus, when the cars are run to their extreme positions, the elongation of the roping R, R', R", R'" due to the change of the balance situation, which elongation would be problematically strong with other ropes, can be at least substantially avoided.

The elevator is preferably, but not necessarily, installed inside a building. Each of the cars is preferably arranged to serve two or more landings (not shown). The elevator responds to calls from the passenger, particularly to calls from landing and/or destination commands from inside the car so as to serve persons on the landing(s) and/or inside the elevator car. Each car has an interior space suitable for receiving a passenger or passengers.

In each of the preferred embodiments, the elevator comprises a hoisting machine for moving said elevator cars. In the preferred embodiments, the hoisting machine is arranged to move the elevator cars by moving the roping R, R', R", R'". Preferably, the hoisting machine comprises a motor M, such as for example an electric motor, for rotating said rotatable rope wheel 3, 3', 3", 3'".

FIGS. 1-4 illustrate different arrangements for the elevator in terms of its suspension and positioning of the cars, as will be later described in further detail. As it is illustrated, the cars can be suspended by the common roping R, R', R", R'" in a common or in different hoistways, with same or different suspension ratios, and there may be same or different number of cars suspended by the roping on opposite sides of the rope wheel 3, 3', 3", 3'".

Figure 5:
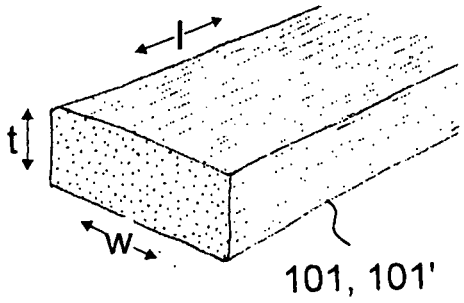
FIG. 5 illustrates three-dimensionally the preferred structure for the load bearing member.
Figure 6:
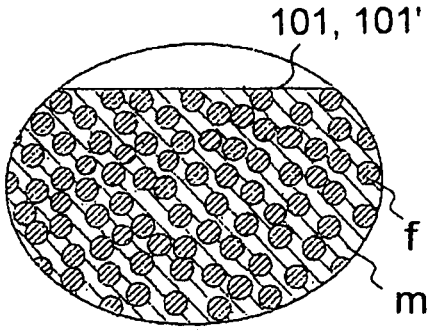
FIG. 6 illustrates the preferred internal structure for the load bearing member of FIG. 5.

FIG. 5 illustrates three-dimensionally the structure of the load bearing member 101, 101'. FIG. 6 illustrates the inner structure of the load bearing member 101, 101', in particular the cross section of the cross-section of the load bearing member 1, 1' as viewed in the longitudinal direction 1 of the load bearing member 101, 101'. The load bearing member 101, 101' is made of composite material comprising reinforcing fibers f embedded in polymeric matrix m. The load bearing member 101, 101' is an elongated rod having a length 1, width w and thickness t. The fibers f are parallel with the longitudinal direction of the load bearing member 101, 101', and the load bearing member 101, 101' is oriented parallel with the length direction of the rope. Thereby, the fibers are aligned with the force when the rope is pulled, which ensures that the structure provides high tensile stiffness. The fibers f of the rope 4, 4', 4", 4*a*",4*b*" used in the preferred embodiments are substantially untwisted in relation to each other, which provides them said orientation parallel with the longitudinal direction of the rope. This is in contrast to the conventionally twisted elevator ropes, where the wires or fibers are strongly twisted and have normally a twisting angle from 15 up to 30 degrees, the fibers/wire bundles of these conventionally twisted elevator ropes thereby having the potential for transforming towards a straighter configuration under tension, which provides these ropes a high elongation under tension.

The preferred inner structure of the load bearing member 101, 101' is more specifically as follows. The load bearing member 101, 101', as well as its fibers f are parallel with the longitudinal direction the rope, and untwisted as far as possible. Individual reinforcing fibers f are bound into a uniform load bearing member with the polymer matrix m. Thus, each load bearing member 101, 101' is one solid elongated rodlike piece. The reinforcing fibers f are preferably long continuous fibers in the longitudinal direction of the rope 4', 4", 4*a*'",4*b*", the fibers f preferably continuing for the whole length of the load bearing member 101, 101' as well as the rope 4', 4", 4*a*'",4*b*". Preferably as many fibers f as possible, most preferably substantially all the fibers f of the load bearing member 101, 101' are oriented parallel with the rope, as far as possible in untwisted manner in relation to each other. Thus the structure of the load bearing member 101, 101' can be made to continue the same as far as possible in terms of its cross-section for the whole length of the rope. The reinforcing fibers f are preferably distributed in the aforementioned load bearing member 101, 101' as evenly as possible, so that the load bearing member 101, 101' would be as homogeneous as possible in the transverse direction of the rope. An advantage of the structure presented is that the matrix m surrounding the reinforcing fibers f keeps the interpositioning of the reinforcing fibers f substantially unchanged. It equalizes with its slight elasticity the distribution of a force exerted on the fibers, reduces fiber-fiber contacts and internal wear of the rope, thus improving the service life of the rope. The composite matrix m, into which the individual fibers f are distributed as evenly as possible, is most preferably of epoxy resin, which has good adhesiveness to the reinforcement fibers f and which is known to behave advantageously with carbon fiber. Alternatively, e.g. polyester or vinyl ester can be used, but alternatively any other suitable alternative materials can be used. FIG. 6 presents a partial cross-section of the load bearing member 101, 101' close to the surface thereof as viewed in the longitudinal direction of the rope presented inside the circle in the figure, according to which cross-section the reinforcing fibers f of the load bearing member s 101, 101' are preferably organized in the polymer matrix m. The rest (not showed parts) of the load bearing member 101, 101' have a similar structure. FIG. 6 presents also how the individual reinforcing fibers f are substantially evenly distributed in the polymer matrix m, which surrounds the fibers and which is fixed to the fibers f. The polymer matrix m fills the areas between individual reinforcing fibers f and binds substantially all the reinforcing fibers f that are inside the matrix m to each other as a uniform solid substance. A chemical bond exists between, preferably all, the individual reinforcing fibers f and the matrix m, one advantage of which is uniformity of the structure. To strengthen the chemical bond, there can be, but not necessarily, a coating (e.g. so called sizing or primer, not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that the individual reinforcing fibers are bound to each other with a polymer matrix m, e.g. in the manufacturing phase by immersing them together in the fluid material of the polymer matrix. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. The reinforcing fibers are preferably distributed substantially evenly in the polymer matrix such that the load bearing member is as homogeneous as possible when viewed in the direction of the cross-section of the rope. In other words, the fiber density in the cross-section of the load bearing member does not therefore vary substantially. The reinforcing fibers f together with the matrix m form a uniform load bearing member, inside which abrasive relative movement does not occur when the rope is bent. The individual reinforcing fibers of the load bearing member 101, 101' are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the load bearing member can comprise material of the polymer matrix around them such that the polymer matrix is immediately against the reinforcing fiber but alternatively a thin coating, e.g. a so called sizing or a primer, arranged on the surface of the reinforcing fiber in the manufacturing phase to improve chemical adhesion to the matrix material, can be in between. Individual reinforcing fibers are distributed evenly in the load bearing member 101, 101' such that the gaps of individual reinforcing fibers f are filled with the polymer of the matrix m. Most preferably the majority, preferably substantially all of the gaps of the individual reinforcing fibers fin the load bearing member 101, 101' are filled with the polymer of the matrix m. As above mentioned, the matrix m of the load bearing member 101, 101' is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix is hard, and in particular non-elastomeric. The most preferred materials are epoxy resin, polyester, phenolic plastic or vinyl ester. The polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. There are commercially available various material alternatives for the matrix m which can provide these material properties. Preferably over 50% of the surface area of the cross-section of the load bearing member is of the aforementioned reinforcing fiber, preferably such that 50%-80% is of the aforementioned reinforcing fiber, more preferably such that 55%-70% is of the aforementioned reinforcing fiber, and substantially all the remaining surface area is of polymer matrix. Most preferably, this is carried out such that approx. 60% of the surface area is of reinforcing fiber and approx. 40% is of matrix material (preferably epoxy material). In this way a good longitudinal stiffness for the load bearing member is achieved 101, 101'.

Figure 7:
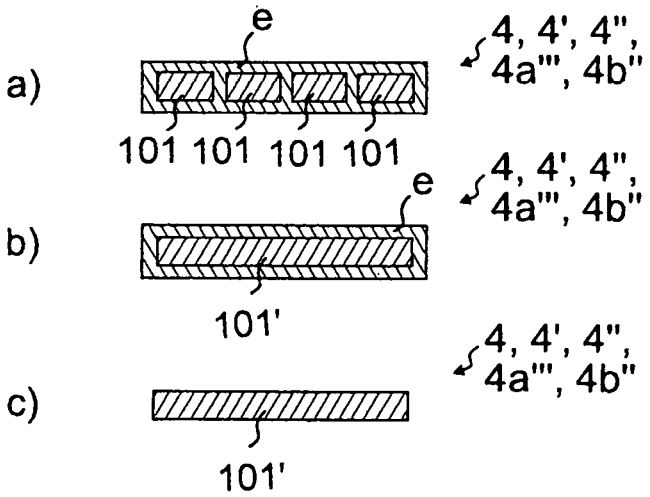
FIG. 7 illustrates the preferred alternative cross-sections for the rope provided with a load-bearing member of FIGS. 5-6.
Figure 8:
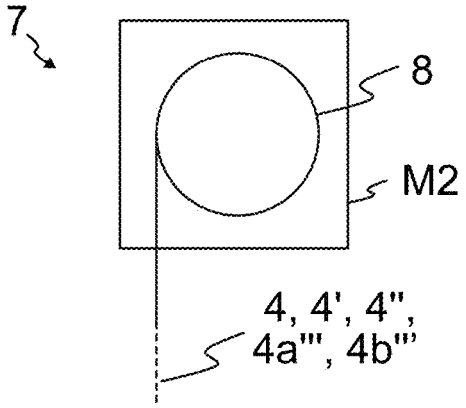
FIG. 8 illustrates an optional arrangement for suspending end(s) of the rope(s) of the roping when the roping is connected to the car via a rope wheel arrangement.

FIG. 7 illustrates alternative preferable cross-sections for the rope 4, 4', 4", 4*a*'''', 4*b*", as well as for the load bearing member(s) 101, 101'. The ropes 4, 4', 4", 4*a*'''', 4*b*" as presented in FIGS. 1-4 can have a cross section of any of FIGS. 7*a*-7*c*.

As presented in the FIGS. 7*a*-7*c*, the rope 4, 4', 4", 4*a*'''', 4*b*" is in the form of a belt, and thereby has a width substantially greater than the thickness thereof. This makes it well suitable for elevator use as considerable bending of the rope is necessary in most elevators. So as to achieve a turning radius well suitable for elevator use, it is preferable that the width/thickness ratio of the rope is at least 2 or more, preferably at least 4, even more preferably at least 5 or more. So as to enable turning radius well suitable for elevator use, it is preferable that the width/thickness ratio(s) of said force transmission member(s) is/are at least 2, preferably at least 3 or more. When the rope 4, 4', 4", 4*a*'''', 4*b*" is made to contain only one load bearing member 110', then it is preferable that the ratio is 5 or more. It is preferable, that all the load bearing member(s) 101, 101' of the rope (irrespective whether there is only one or more of them in the rope) cover together majority, preferably 70% or over, more preferably 75% or over, most preferably 80% or over, of the width of the rope. Thus, the width of the rope is effectively utilized for the function of load bearing.

In the embodiment as illustrated in FIG. 7*a*, the rope 4, 4', 4", 4*a*'''', 4*b*" comprises a plurality of load bearing members 101. These plural load bearing members 1 are placed adjacent each other in the width direction of the belt and on the same plane. In the embodiment as illustrated in FIG. 7*b*, the rope 4, 4', 4", 4*a*'''', 4*b*" comprises only one load bearing member 101'. In both of these embodiments, the load bearing member(s) 101, 101' is/are surrounded with a layer e, which layer e forms the surface of the rope protecting the load bearing member(s) 101, 101'. The layer e is preferably of polymer, most preferably of elastic polymer, such as of polyurethane, as it provides good wear resistance, protection and good friction properties, for instance for frictional traction contact with the rope wheel 3,3',3",3'''. In both of these embodiments, the load bearing member(s) 101, 101' have a width greater than the thickness thereof as measured in width-direction of the rope 4, 4', 4", 4*a*'''', 4*b*". In the embodiment as illustrated in FIG. 7*b*, the rope 4, 4', 4", 4*a*'''', 4*b*" comprises only one load bearing member 101' without the polymer layer p.

In this application, the term load bearing member of a rope refers to the part that is elongated in the longitudinal direction of the rope, and which part is able to bear without breaking a significant part of the load exerted on the rope in question in the longitudinal direction of the rope. The aforementioned load exerted on the rope causes tension on the load bearing member in the longitudinal direction of the load bearing member, which tension can be transmitted inside the load bearing member in question all the length of the load bearing member, e.g. from one end of the load bearing member to the other end of it.

In the embodiment as illustrated in FIG. 1, the first elevator car 1 and the second elevator car 2 are arranged to travel vertically in a common hoistway H one above the other. The first and the second car 1, 2 are both suspended by the common roping R with a suspension ratio 1:1. The first end of the rope(s) of the roping R is/are fixed to the first car 1 and the second end(s) of the rope(s) of the roping R is/are fixed to the second car 2. On first side of the rope wheel 3 the rope(s) 4 descend(s) to the first elevator car 1 passing the second car 2 at the side thereof. The rope(s) 4 descend(s) further to a rope wheel arrangement 5, which is mounted on a fixed location and arranged to guide the rope(s) laterally to descend to the first car 1 within the vertical projection thereof. The end(s) of rope(s) 4 descending to the first car 1 within the vertical projection of the first car 1 are fixed to a fixing point on top of the first car 1, in particular to a fixing point at the center of the roof of the first car 1. On the second side of the rope wheel 3 the rope(s) 4 descend(s) to the second elevator car 2. The end(s) of rope(s) 4 descending to the second car 1 are fixed to a fixing point on top of the second car 2, in particular to a fixing point at the center of the roof of the second car 2. With this kind of roping arrangement, the cars 1 and 2 can be arranged to travel in the same hoistway H. The rope wheel arrangement 5 is preferably positioned vertically between successive landings L2, L3, in particular partially or wholly if possible within the horizontal projection of the floor between the successive landings L2, L3. The cars 1 and 2 are suspended with ratio 1:1, so their traveling zones Z1 and Z2 are of equal length. The elevator system comprises at least two landings L1, L2; L3, L4 for each of the two elevator cars 1, 2, i.e. where the elevator car in question can stop and load or unload, positioned such that when the first elevator car 1 is level with one of its landings L1,L2, the second elevator car 2 is level with one of its landings L3,L4. In particular, the elevator system comprises at least two landings L1, L2; L3, L4 for each of the two elevator cars 1,2, which landings are positioned such that when the first elevator car 1 is down in the hoistway H and level with a first landing L1, the second elevator car 2 is up in the hoistway H and level with a fourth landing L4, and when the first elevator car 1 is up in the hoistway H and level with a second landing L2, the second elevator car 2 is down in the hoistway H and level with a third landing L3. Preferably, the second landing L2 and the third landing L3 are successive landings of a building having said elevator system. It is preferable that said second landing L2 is the topmost landing L2 of the first elevator car 1 and the third landing L3 is the lowermost landing of the second elevator car 2. Accurate and easy leveling enabled by the stiff rope structure enables the defined configuration where the margin for distance variations between the cars traveling one above each other is very short, which results from the feature that the topmost landing of the first elevator car and the lowermost landing of the second elevator car are successive landings of the building.

Figure 2:
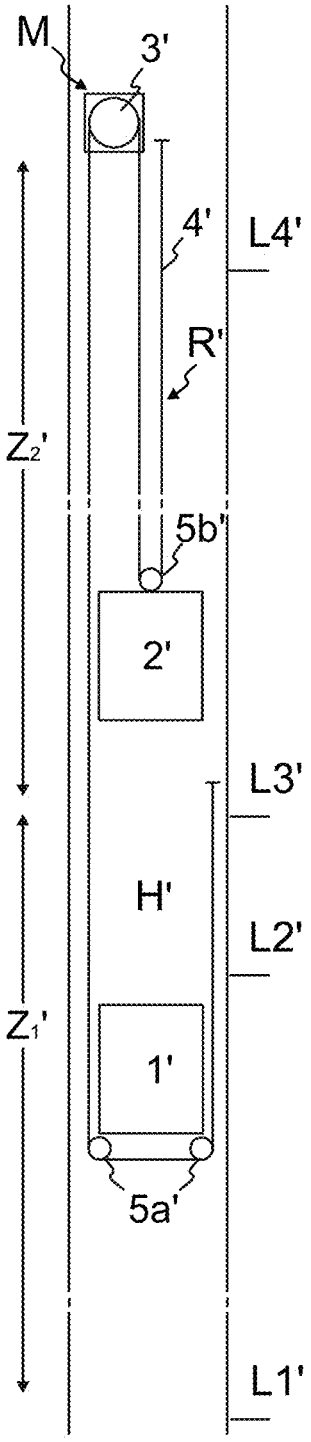
FIG. 2 illustrates a second preferred embodiment of the elevator system.

In the embodiment as illustrated in FIG. 2, the first elevator car 1' and the second elevator car 2' are also arranged to travel vertically in a common hoistway H' one above the other. The elevator has in this case the same number of cars 1', 2' suspended by the roping on the opposite sides of the rope wheel 3'. The first and the second car 1', 2' are both suspended by the common roping R' with a suspension ratio 2:1. On the first side of the rope wheel 3' the rope(s) R' is/are connected to the first car 1' via a first rope wheel arrangement 5*a*' and on the second side of the rope wheel 3' the rope(s) R' is/are connected to the second car 2' via a second rope wheel arrangement 5*b*'. The first end of the rope(s) of the roping R' as well as the second end(s) of the rope(s) of the roping R' is/are suspended by fixing on a fixed location. On the first side of the rope wheel 3' the rope(s) 4' descend(s) to the first elevator car 1' passing the second car 2' at the side thereof and further to a rope wheel arrangement 5*a*' mounted on the first elevator car 1'. The rope(s) 4' are guided to underloop the first car 1', which is in this case the lower of the first and second car 1',2'. For this purpose, the rope wheel arrangement 5*a*" is mounted below the first car 1'.

On the second side of the rope wheel 3' the rope(s) 4' descend(s) to the second elevator car 2', in particular to a rope wheel arrangement 5*b*' mounted on the second elevator car 2'. The rope wheel arrangement 5*b*' of the second elevator car 2' is mounted on top of second the car 2', which is in this case the upper of the first and second car 1',2' traveling in a common hoistway H'. With this kind of roping 2:1 arrangement, the cars 1 and 2 can be arranged to travel in the same hoistway H in a space-efficient manner. In particular, the cars 1', 2' not having their supporting points between them, makes it possible to drive them very close to each other. The cars 1 and 2 are suspended with the same suspension ratio 2:1, so their traveling zones Z1' and Z2 are of equal length. The elevator system comprises at least two landings L1', L2'; L3', L4' for each of the two elevator cars 1', 2', i.e. where the elevator car in question can stop and load or unload, positioned such that when the first elevator car 1' is level with one of its landings L1',L2', the second elevator car 2 is level with one of its landings L3',L4'. In particular, the elevator system comprises at least two landings L1', L2'; L3',L4' for each of the two elevator cars 1',2', which landings are positioned such that when the first elevator car 1' is down in the hoistway H' and level with a first landing L1', the second elevator car 2' is up in the hoistway H' and level with a fourth landing L4', and when the first elevator car 1 is up in the hoistway H' and level with a second landing L2', the second elevator car 2' is down in the hoistway H' and level with a third landing L3'. Preferably, the second landing L2' and the third landing L3' are successive landings of the building having said elevator system. It is preferable that said second landing L2' is the topmost landing L2' of the first elevator car 1 and the third landing L3' is the lowermost landing of the second elevator car 2'.

Figure 3:
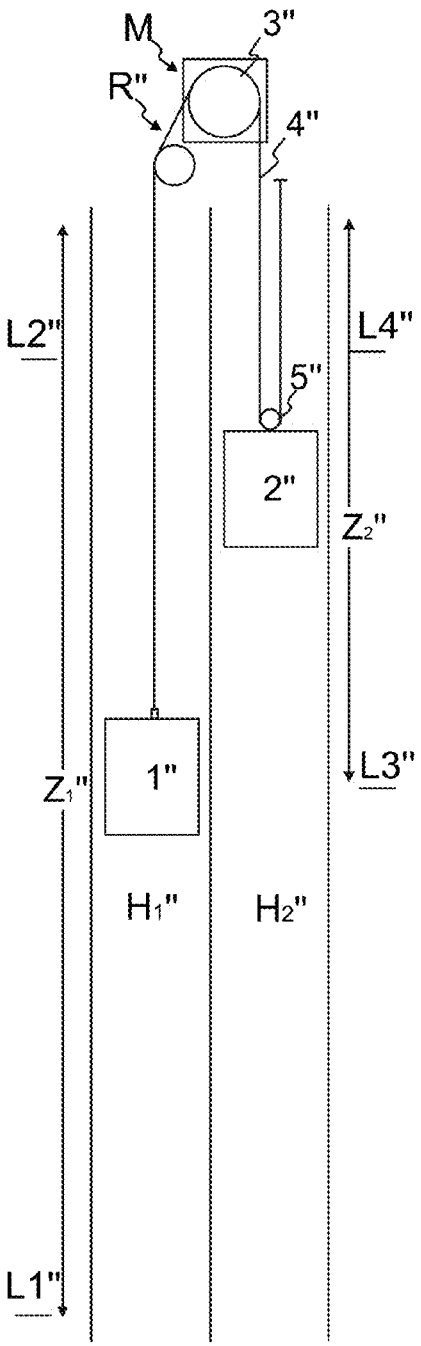
FIG. 3 illustrates a third preferred embodiment of the elevator system.

In the embodiment as illustrated in FIG. 3, the first elevator car 1" and the second elevator car 2" are arranged to travel vertically in adjacent hoistways H1", H2". Thus, they can simply share a floor to be served. The first car 1" and the second car 2" are suspended by the roping R" with different suspension ratios. Thus, they have different traveling lengths. In this case, the first elevator car 1" is suspended by the common roping R" R" with a suspension ratio 1:1 and the second elevator car 2" is suspended by the common roping R" with a suspension ratio 2:1. Thereby, the traveling zone Z1" of the first car 1" has twice the length of the traveling zone Z2" of the second elevator car 2". On the first side of the rope wheel 3" the end(s) of the rope(s) 4" is/are fixed to the first car 1", and on the second side of the rope wheel 3" the rope(s) 4" is/are is connected to the second car 2" via rope wheel arrangement 5". The elevator system comprises at least two landings L1“, L2”; L3", L4" for each of the first and second elevator cars 1", 2", i.e. where the elevator car in question can stop and load or unload, positioned such that when the first elevator car 1" is level with one of its landings L1“,L2”, the second elevator car 2" is level with one of its landings L3",L4". In particular, the elevator system comprises at least two landings L1“, L2”; L3",L4" for each of the two elevator cars 1",2", which landings are positioned such that when the first elevator car 1" is down in its hoistway H1" and level with a first landing L1“, the second elevator car 2” is up in its hoistway H2" and level with a fourth landing L4", and when the first elevator car 1" is up in its hoistway H1" and level with a second landing L2", the second elevator car 2" is down in its hoistway H2" and level with a third landing L3". Preferably, the first and second car 1", 2" have a landing on the same vertical level of the building. In the preferred embodiment as illustrated, the second landing L2" and the fourth landing L3" are on the same vertical level of the building, and preferably accessible from a same lobby. Thus, the first elevator car 1" can serve as a shuttle elevator and the second elevator car 2" as a local elevator.

Figure 4:
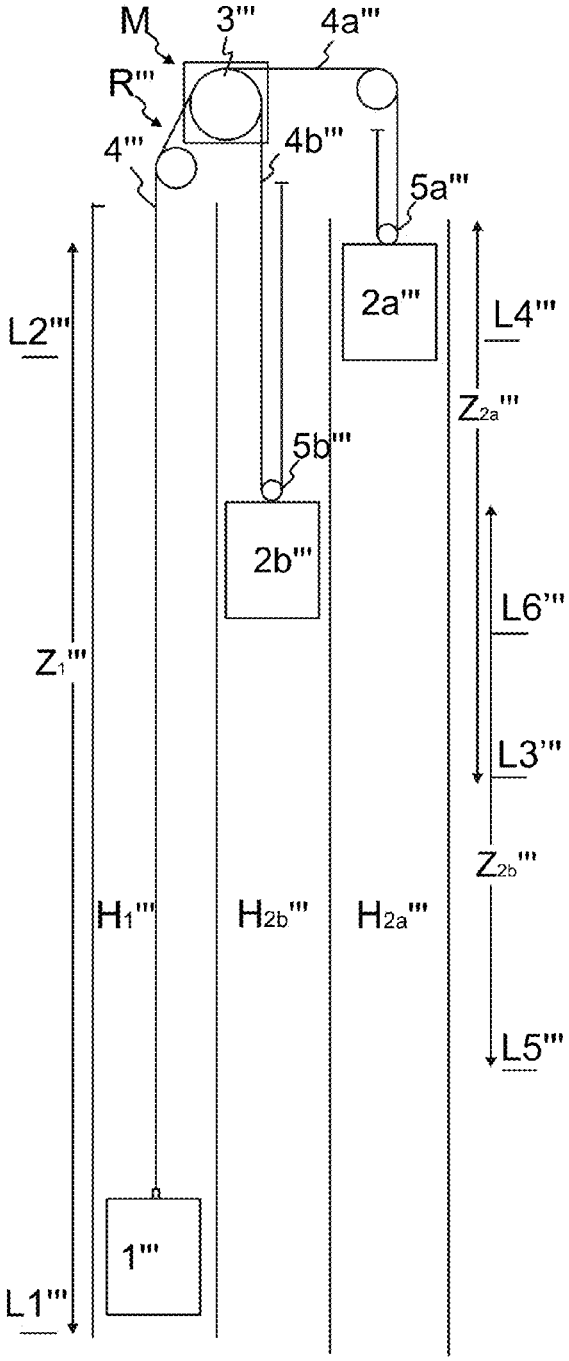
FIG. 4 illustrates a fourth preferred embodiment of the elevator system.

In the embodiments as illustrated in FIG. 4, the roping R''' suspends a different number of cars on the opposite sides of the rope wheel 3'''. In particular, there is one first elevator car 1''' and two second elevator cars 2*a*''',2*b*''' suspended by the common roping R'''. The first elevator car 1' and the second elevator cars 2*a*''', 2*b*''' are arranged to travel vertically in adjacent hoistways H1", H2"; H1''', H2*a*''', H2*b*'''. Thus, they can simply share a floor to be served and their traveling zones can be chosen relatively freely. The roping R''' comprises a plurality of ropes 4'''. On the first side of the rope wheel 3''' the ropes 4''' of the roping R''' are connected to one first car 1' and on the second side part 4*a*''' of the ropes 4''' is connected to a first second car 2*a*''' and part 4*b*''' of the ropes 4''' of the roping R''' is connected to a second second car 2*b*''''. Preferably, the roping R''' comprises a plurality of ropes 4''', such as for example six ropes and on the first side of the rope wheel 3''' all the ropes 4''' of the roping R''' are connected to one first car 1' and on the second side the first half 4*a*''' (in this preferred example three ropes 4''') of the ropes 4' are connected to a first second car 2*a*''' and the second half 4*b*''' of the ropes 4''' (in this preferred example three ropes 4''') of the roping R''' is/are connected to a second second car 2*b*". Thus, the same roping R''' can suspend a different number of cars on the opposite sides of the rope wheel 3'''. The first car 1' and the second cars 2*a*''',2*b*''' are suspended by the roping R''' with different suspension ratios. In particular, the suspension ratio of the first car is 1:1 and the suspension ratio of the second cars is 2:1. Due to this difference in ratio, the smaller amount of ropes 4''' for the second cars 2*a*''',2*b*''' can be compensated. For providing different ratios, on the first side of the rope wheel 3''' the ends of all the ropes 4''' are fixed to the one first car 1''' and on the second side part 4*a*''' of the ropes 4''' is connected to a first second car 2*a*''' via a rope wheel arrangement 5*a*''' and part 4*b*''' of the ropes 4''' of the roping R''' is connected to a second second car 2*b*''''' via a rope wheel arrangement 5*b*'''. Due to the different suspension ratios, the first car 1' and the second cars 2*a*''',2*b*''' have different traveling lengths. In this case, the traveling zone Z1''' of the first car 1" has twice the length of the traveling zones Z2*a*", Z2*b*" of the second elevator cars 2*a*''', 2*b*'''. Due to the stiffness of the ropes 4''' the traveling zones Z2*a*", Z2*b*" of the second elevator cars 2*a*''', 2*b*''' can be vertically displaced, as in this case there are no problematic differences or changes in rope elongation.

The elevator system comprises at least two landings L1''', L2'''; L3''', L4'''; L5''', L6''' for each of the first and second elevator cars 1', 2*a*''',2*b*''' i.e. where the elevator car in question can stop and load or unload, positioned such that when the first elevator car 1' is level with one of its landings L1''',L2''', the second elevator car 2*a*''' is level with one of its landings L3''',L4''' and/or the second elevator car 2*b*''' is level with one of its landings L3''',L4'''. In particular, the elevator system comprises at least two landings L1''', L2'''; L3''', L4'''; L5''', L6''' for each of the elevator cars 1''', 2*a*''', which landings are positioned such that when the first elevator car 1' is down in its hoistway H1''' and level with a first landing L1''', the second elevator car 2*a*''' is up in its hoistway H2*a*''' and level with a fourth landing L4', and when the first elevator car 1''' is up in its hoistway H1''' and level with a second landing L2", the second elevator car 2*a*''' is down in its hoistway H2*a*''' and level with a third landing L3'. Preferably, the second landing L2''' and the fourth landing L4''' are on the same vertical level of the building, and preferably accessible from a same lobby. Thus, the first elevator car 1' can serve as a shuttle elevator and the second elevator car 2*a*''' as a local elevator. Furthermore, it is preferable that said at least two landings L1''', L2'''; L3", L4'''; L5", L6''' for each of the elevator cars 1''', 2*a*''',2*b*''', are positioned such that when the first elevator car 1' is down in its hoistway H1' and level with a first landing L1''', the second elevator car 2*b*''' is up in its hoistway H2*b*''' and level with a sixth landing L6''', and when the first elevator car 1''' is up in its hoistway H1''' and level with a second landing L2''', the second elevator car 2*b*''' is down in its hoistway H21)''' and level with a fifth landing L5'''. Preferably, the first car 1''' and one or both of the second cars 2*a*''', 2*b*''' have a landing on the same vertical level of the building. This landing may be one illustrated but the elevator system may include further landings for any of the cars so this landing on the same vertical level of the building need not be one illustrated. The first elevator car 1''' may stop on the level of the landing L6''' and/or L3''', for instance. In the preferred embodiment as illustrated, the second landing L2" and the fourth landing L4" are on the same vertical level of the building, and preferably accessible from a same lobby. Thus, the first elevator car 1''' can serve as a shuttle elevator and the second elevator car 2*a*''' as a local elevator.

FIG. 7 illustrates a suspension arrangement 6, which can be used instead of the rope end fixings any of the embodiments as illustrated in FIGS. 2-4. In that case, the rope end arriving upwards from rope wheel arrangement 5*a*' and/or 5*b*'; 5"; 5*b*''' and/or 5*b*''' may be suspended by the suspension arrangement 6 as illustrated in FIG. 7 instead of being suspended by fixing on a fixed location. The suspension arrangement 7 comprises a wheel 8 rotatable with a motor M2, the suspension arrangement thereby being able to shorten the loop of the rope passing around the rope wheel(s) of the rope wheel arrangement in question. In this case, the wheel 8 is in the form of a drum, arranged to wind the rope(s) 4', 4", 4*a*''', 4*b*" around it. Alternative to the winding drum solution, the rope wheel could be in the form of a traction wheel around which the rope(s) 4', 4", 4*a*''', 4*b*" pass with counterweight on one side and the car on the other side. With the defined suspension arrangement(s) the loop length can be controlled and the length of the traveling zone of the car in question increased. For the purpose of increasing the length of the traveling zone, the rope wheel 8 is arranged to be rotated with the motor M2 at the same time as the motor M moves the elevator cars. Additionally or alternatively, the wheel 8 is arranged to be rotated with the motor M2 for adjusting the leveling of the car hanging between the rope wheels 3 and 8 when the car is arriving at a landing. However, the suspension arrangement 6 is not necessary, because the increasing of the traveling zone is an optional feature and the adjusting the leveling of the car is not necessary in this elevator system due to the special structure and properties of the ropes of the roping R, R', R", R'''. Thereby, in the preferred embodiments as illustrated in FIGS. 1-4 the elevator system is designed to have only one motor M for driving the roping R, R', R", R''' by rotating a rope wheel, which makes the elevator system simple and space-efficient.

In any of the above embodiments, the rope wheel arrangement 5*a*', 5*b*', 5", 5*a*'", 5*b*'", mounted on the car 2', 2", 2*a*'", 2*b*'", may comprise one or more rope wheels around which the rope(s) guided by it pass.

In the illustrated embodiments, said rotatable rope wheel (3, 3', 3", 3'") and the motor M for rotating said rotatable rope wheel (3, 3', 3", 3") are both within the hoistway in which the first and/or the second elevator car is/are arranged to travel. Thus, the space efficiency of the elevator system can be improved. The mounting location does no, however, need to be in a hoistway as the system can alternatively be provided with a machine room for said components. The rotatable rope wheel 3, 3', 3", 3'" is in any case, most preferably mounted on a fixed location above the elevator cars as illustrated.

Figure 9:
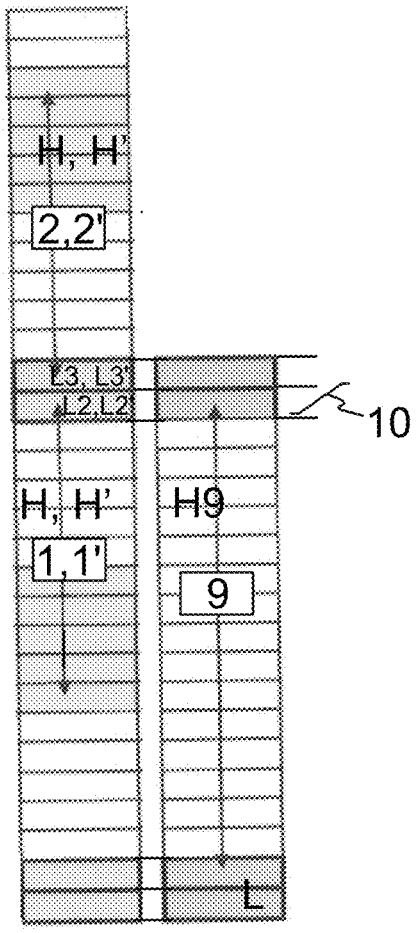
FIG. 9 illustrates the elevator system of FIG. 1 or 2 implemented in a tower building.

FIG. 9 illustrates the elevator system of FIG. 1 or 2 is implemented in a tower building. A topmost landing L2,L2' of the first elevator car 1,1' and a lowermost landing L3,L3' of the second elevator car 2,2' are successive landings of the building. The elevator system comprises a shuttle elevator car 9, which is arranged to travel in a different hoistway H9 and to transport passengers between building lobby L and one or both of said landings L2,L2' and L3,L3'. The shuttle elevator 9 may be a double decker with two platforms arranged to stop so that the two platforms are level with the successive landings L2,L2' and L3,L3' simultaneously. Alternatively, a shuttle elevator 9 of any other kind can be arranged to stop at one of the landings L2,L2' and L3,L3' and the passenger can take an escalator 10, provided to traffic between landings L2,L2' and L3,L3'. Said building lobby L is preferably either an exit lobby of the building, such as a lobby substantially at the ground level of the surroundings of the building, or a skylobby of the building. Said building lobby L is preferably located substantially lower than the lowermost landing L1,L1' of the first car 1,1', which is the lower of the first and second car 1,2; 1',2' traveling in a common hoistway H,H'. The shuttle elevator car 9 is arranged to transport passengers without intermediate stops between said lobby L of the building and one or both of said successive landings L2,L3; L2',L3'.

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator system comprising:

a first elevator car;

a second elevator car;

a rotatable rope wheel mounted in a fixed location; and at least one rope suspending the first and second elevator cars on first and second sides of the rotatable rope wheel, respectively, the at least one rope passing over the rotatable rope wheel, and connecting on the first side of the rotatable rope wheel to the first elevator car and on the second side to the second elevator car, wherein each of the at least one rope includes at least one load bearing member oriented parallel with a longitudinal direction of the at least one rope, the load bearing member being made of a composite material including reinforcing fibers embedded in a polymer matrix, the reinforcing fibers being carbon fibers oriented parallel to the longitudinal direction of the at least one rope, and a topmost landing of the first elevator car and a lowermost landing of the second elevator car are successive landings of a building including the elevator system, the successive landings being successive floors of the building.

2. The elevator system according to claim 1, further comprising:

at least two landings for the first elevator car and at least two landings for the second elevator car, positioned such that when the first elevator car is level with one of the at least two landings for the first elevator car, the second elevator car is level with one of the at least two landings for the second elevator car.

3. The elevator system according to claim 1, further comprising:

at least two landings for the first elevator car and at least two landings for the second elevator car, positioned such that when the first elevator car is down in a hoistway of the first elevator car and level with one of the at least two landing for the first elevator car, the second elevator car is up in a hoistway of the second elevator car and level with one of the at least two landing for the second elevator car, and when the first elevator car is up in the hoistway of the first elevator car and level with one of the at least two landing for the first elevator car, the second elevator car is down in the hoistway of the second elevator car and level with one of the at least two landing for the second elevator car.

4. The elevator system according to claim 1, further comprising:

a hoisting machine configured to move the first elevator car and second elevator car, the hoisting machine including a motor configured to rotate the rotatable rope wheel.

5. The elevator system according to claim 1, wherein each of the at least one rope is in the form of a belt.

6. The elevator system according to claim 1, wherein the first elevator car and the second elevator car are arranged to travel vertically in a common hoistway, the second elevator car being above the elevator first car in the common hoistway.

7. The elevator system according to claim 6, wherein, on the first side of the rotatable rope wheel, the at least one rope connects to the first elevator car passing the second elevator car on a side of the second elevator car.

8. The elevator system according to claim 1, wherein a first end of the at least one rope is fixed to the first elevator car and a second end of the at least one rope is fixed to the second elevator car.

9. The elevator system according to claim 1, wherein on the first side of the rotatable rope wheel, the at least one rope is connected to the first elevator car via a first rope wheel arrangement mounted on the first elevator car, and on the second side of the rotatable rope wheel, the at least one rope is connected to the second elevator car via a second rope wheel arrangement mounted on the second elevator car.

10. The elevator system according to claim 9, wherein the first rope wheel arrangement is mounted below the first elevator car, the first elevator car being lower in a common hoistway than the second elevator car.

11. The elevator system according to claim 1, wherein the first elevator car and the second elevator car are arranged to travel vertically in adjacent hoistways.

12. The elevator system according to claim 1, wherein on the first side of the rotatable rope wheel, a first end of the at least one rope is fixed to the first elevator car, and on the second side of the rotatable rope wheel, the at least one rope is connected to the second elevator car via a rope wheel arrangement mounted on the second elevator car.

13. The elevator system according to claim 1, wherein the at least one rope suspends a different number of elevator cars on the first side and the second side of the rotatable rope wheel.

14. The elevator system according to claim 1, wherein on the first side of the rotatable rope wheel, the at least one rope is connected to the first elevator car, and on the second side of the rotatable rope wheel, at least one of the at least one rope is connected to the second elevator car, and at least another of the at least one rope is connected to a third elevator car.

15. The elevator system according to claim 1, wherein on the first side of the rotatable rope wheel, a first end of the at least one rope is connected to the first elevator car, and on the second side of the rotatable rope wheel, at least one of the at least one rope is connected to the second elevator car via a first rope wheel arrangement mounted on the second elevator car, and at least another of the at least one rope is connected to a third elevator car via a second rope wheel arrangement mounted on the third elevator car.

16. The elevator system according to claim 1, wherein the elevator system further comprises:

a shuttle elevator car, which is configured to travel in a different hoistway than the first elevator car and the second elevator car, and to transport passengers between a lobby of the building and at least one of the successive landings.

17. The elevator system according to claim 16, wherein the lobby of the building is located substantially lower than the lowermost landing of the first elevator car which is a lower elevator car of the first and second elevator cars traveling in a common hoistway.

18. The elevator system according to claim 16, wherein the lobby of the building is either an exit lobby of the building substantially at a ground level of surroundings of the building, or a skylobby of the building.

19. The elevator system according to claim 16, wherein the shuttle elevator car is configured to transport passengers without intermediate stops between the lobby of the building and at least one of the successive landings.

20. The elevator system according to claim 1, further comprising:

an escalator configured to transport passengers between the topmost landing of the first elevator car and the lowermost landing of the second elevator car.

21. The elevator system according to claim 1 wherein the first elevator car and the second elevator car are configured to travel vertically in a common hoistway one above the other, and a topmost landing of the first elevator car and a lowermost landing of the second elevator car are successive landings of a building including the elevator system.

22. The elevator system according to claim 1, further comprising:

a rope wheel arrangement including at least two rope wheels, at least one of the at least two rope wheels being between the first elevator car and the second elevator car, the at least one of the at least two rope wheels being between the successive landings, wherein, the at least one roping suspends the first elevator car via the rope wheel arrangement.

* * * * *